US007645508B2

(12) United States Patent
Uemura

(10) Patent No.: US 7,645,508 B2
(45) Date of Patent: Jan. 12, 2010

(54) POLYESTER COMBINED-FILAMENT YARN AND WOVEN OR KNITTED FABRIC COMPRISING IT

(75) Inventor: Ryuji Uemura, Bangpakong (TH)

(73) Assignee: Tejin Fibers Limited, Osaka (JP)

( * ) Notice: Subject to any disclaimer, the term of this patent is extended or adjusted under 35 U.S.C. 154(b) by 524 days.

(21) Appl. No.: 11/658,495

(22) PCT Filed: Jul. 27, 2005

(86) PCT No.: PCT/JP2005/014236

§ 371 (c)(1),
(2), (4) Date: Jan. 25, 2007

(87) PCT Pub. No.: WO2006/011652

PCT Pub. Date: Feb. 2, 2006

(65) Prior Publication Data

US 2009/0013662 A1 Jan. 15, 2009

(30) Foreign Application Priority Data

Jul. 30, 2004 (JP) ..... 2004-223234

(51) Int. Cl.
*D02G 3/00* (2006.01)

(52) U.S. Cl. ..... 428/370; 428/374; 428/395; 57/238; 442/199

(58) Field of Classification Search ..... 428/370, 428/374, 395, 364, 373; 57/238; 442/195, 442/199; 8/115.69, 836
See application file for complete search history.

(56) References Cited

U.S. PATENT DOCUMENTS 5,441,543 A * 8/1995 Kobayashi ..... 8/585
5,545,833 A * 8/1996 Stoddard ..... 528/337
6,306,499 B1 * 10/2001 Ochi et al. ..... 428/364
6,770,365 B2 * 8/2004 Yoshimura et al. ..... 428/373
6,811,872 B2 * 11/2004 Kasaoka et al. ..... 428/364
6,821,914 B2 * 11/2004 Mizumura et al. ..... 442/192
7,097,904 B2 * 8/2006 Ochi et al. ..... 428/370
2009/0013662 A1 * 1/2009 Uemura ..... 57/238

FOREIGN PATENT DOCUMENTS

| | | | |
|---|---|---|---|
| JP | 58-104215 | A | 6/1983 |
| JP | 02-307930 | A | 5/1989 |
| JP | 2-293411 | A | 12/1990 |
| JP | 3-64543 | A | 3/1991 |
| JP | 07-324239 | A | 12/1995 |
| JP | 2003-286621 | A | 10/2003 |
| JP | 2003-293234 | A | 10/2003 |
| JP | 2004-197231 | A | 7/2004 |
| WO | 2004/009702 | A1 | 1/2004 |

* cited by examiner

*Primary Examiner*—N. Edwards
(74) *Attorney, Agent, or Firm*—Sughrue Mion, PLLC

(57) ABSTRACT

A polyester combined-filament yarn having an excellent stretch property and a bathochromic effect, as well as uniformity of apparent dyed color density, comprises two different multifilament components (A) and (B), wherein the multifilament component (A) comprises polyester filaments composed of polyethylene terephthalate (PET) polymer, a metal-containing phosphorus compound (a) and an alkaline earth metal compound (b), and a conjugate multifilament component (B) comprises side-by-side or eccentric core-sheath conjugate polyester filaments composed of two mutually different polyester resins (at least one of which is polytrimethylene terephthalate resin), the mass ratio (A)/(B) of components (A) and (B) is in the range of 80/20 to 50/50. Woven or knitted fabrics comprising the combined-filament yarn are useful for women's and men's fashion apparel and black formals.

20 Claims, 1 Drawing Sheet

POLYESTER COMBINED-FILAMENT YARN AND WOVEN OR KNITTED FABRIC COMPRISING IT

FIELD OF THE INVENTION

The present invention relates to polyester combined-filament yarns and a woven or knitted fabric comprising the yarns. More specifically, the invention relates to polyester combined-filament yarn capable of forming a woven or knitted fabric having an excellent stretch property and bathochromic effect, and a uniform dyeing property, and to a woven or knitted fabric comprising the polyester combined-filament yarn.

BACKGROUND ART

Japanese Unexamined Patent Publication No. 2002-275736 (patent document 1) and Japanese Unexamined Patent Publication No. 2003-286621 (Patent document 2) disclose, for stretchable woven or knitted fabrics, production of a conjugate filament with a latent crimped property from two different polyester resins, production of a combined-filament yarn comprising the latent-crimped conjugate filament, production of a woven or knitted fabric using the combined-filament yarn and a process of dyeing the woven or knitted fabric which includes heat treatment, to express the latent-crimped property of the conjugate filament and obtain a polyester woven or knitted fabric with an excellent stretch property.

Also, Japanese Unexamined Patent Publication No. 2003-293234 (Patent document 3) discloses combining an elastic filament with a polyester film which exhibits a self-elongation property under heating and using the obtained combined-filament yarn to produce a woven or knitted fabric with an excellent stretch property.

For a woven or knitted fabric with a bathochromic effect, Japanese Examined Patent Publication No. 62-44064 (Japanese Unexamined Patent Publication No. 58-104215, Patent document 4) discloses producing a polyester fiber comprising a polyester resin with a metal-containing phosphorus compound and an alkaline earth metal compound, using the polyester to produce a woven or knitted fabric, and subjecting the polyester woven or knitted fabric to alkali reduction treatment to form fine pores in the surface of the polyester fiber to obtain a woven or knitted fabric with an excellent bathochromic effect.

However, polyester woven or knitted fabrics having both an excellent stretch property and bathochromic effect, and polyester filaments composing such woven or knitted fabrics, are still unknown. Preferably, no dyeing variation is produced in such a polyester woven or knitted fabric which exhibits an excellent stretch property and a bathochromic effect.

Patent Documents

1. Japanese Unexamined Patent Application No. 2002-275736
2. Japanese Unexamined Patent Publication No. 2003-286621
3. Japanese Unexamined Patent Publication No. 2003-293234
4. Japanese Examined Patent Publication No. 62-44064 (Japanese Unexamined Patent Publication No. 58-104215)

SUMMARY OF THE INVENTION

An object of the present invention is to provide polyester combined-filament yarns which are useful as filament yarns from which a woven or knitted fabric is constituted and which has an excellent stretch property and a bathochromic effect, and uniform dyeing property, and a polyester woven or knitted fabric produced from the polyester combined-filament yarns having an excellent stretch property and bathochromic effect and a uniform dyeing property.

The aforementioned object is achieved by the polyester combined-filament yarn of the invention.

The polyester combined-filament yarn of the invention is a combined-filament yarn comprising a multifilament component (A) and a conjugate multifilament component (B) which are combined together, characterized in that the multifilament component (A) comprises a plurality of filaments comprising a polyethylene terephthalate resin composition, the polyethylene terephthalate resin composition comprising polyethylene terephthalate polymer, with a metal-containing phosphorus compound (a) represented by the general formula (I):

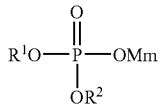

(I)

wherein $R^1$ and $R^2$ respectively and independently from each other represent a monovalent organic group, M represents an alkali metal atom or alkaline earth metal atom, and m represents an integer of 1 when M is an alkali metal atom and represents a numeric of ½ when M is an alkaline earth metal atom, and an alkaline earth metal compound (b), the metal-containing phosphorus compound (a) and alkaline earth metal compound (b) being mixed, during the production process of the polyethylene terephthalate polymer, into the reaction mixture, the conjugate multifilament component (B) comprises a plurality of polyester conjugate filaments having a side-by-side or eccentric core-in-sheath conjugate fiber structure formed from two mutually different polyester resins, wherein at least one of the two mutually different polyester resins is polytrimethylene terephthalate resin, and the mass ratio ((A)/(B)) of the multifilament component (A) to the conjugate multifilament component (B) is in the range of 80:20 to 50:50.

In the combined-filament yarn of the present invention, the content of the metal-containing phosphorus compound (a) in the polyethylene terephthalate filament of said multifilament component (A) is 0.5-3.0 mole percent of the molar amount of terephthalic acid component composing from which the polyethylene terephthalate resin is formed, and the content of the alkaline earth metal compound (b) is 50-120 mole percent of the molar amount of the metal-containing phosphorus compound (a).

In the combined-filament yarn of the present invention, the polyethylene terephthalate filament in the multifilament component (A) is selected from undrawn multifilaments that exhibit a self-elongation property upon dry heating at a temperature of 180° C.

In the combined-filament yarn of the present invention, the side-by-side or eccentric core-in-sheath polyester conjugate filament in the multifilament component (B) is constituted from a polyethylene terephthalate resin and a polytrimethylene terephthalate resin.

In the combined-filament yarn of the present invention, the multifilament component (A) and conjugate multifilament component (B) are combined by passing them through an air entangling nozzle, whereby the individual filaments in the components (A) and (B) are combined and entangled with each other.

In the combined-filament yarn of the present invention, the number of twists is 150-3000 T/m.

The woven or knitted fabric of the present invention comprises polyester combined-filament yarns of the present invention.

In the woven or knitted fabric of the present invention, a plurality of fine pores are formed in the filament surfaces of the polyethylene terephthalate filaments contained in the combined-filament yarn, by an alkali reduction treatment.

In the woven or knitted fabric of the present invention, at least one type of the filaments contained in the multifilament components (A) and (B) are colored by a dyeing treatment.

The present invention provides a polyester combined-filament yarn having an excellent stretch property and a bathochromic effect, and the yarn may be used to provide a woven or knitted fabric having an excellent stretch property and a bathochromic effect and a uniform dyeing property.

BEST MODE FOR CARRYING OUT THE INVENTION

Figure 1:
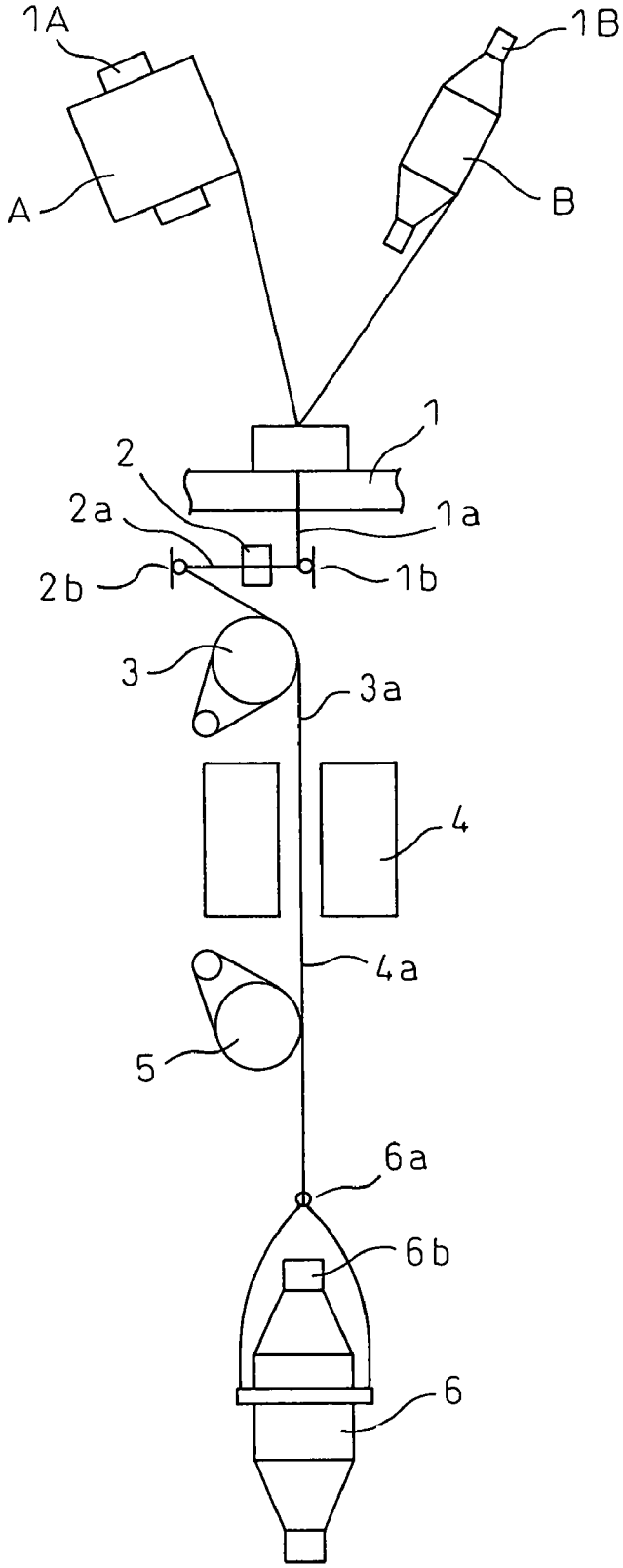
FIG. 1 is an explanatory diagram for an embodiment of a combined-filament yarn production apparatus used for production of a polyester combined-filament yarn according to the present invention.

The combined-filament yarn of the present invention is constituted from a multifilament component (A) and a conjugate multifilament component (B) combined together. The multifilament component (A) for the combined-filament yarn of the present invention comprises a plurality of filaments comprising of a polyethylene terephthalate resin composition, and the polyethylene terephthalate resin composition for the filaments comprises a polyethylene terephthalate polymer, and a metal-containing phosphorus compound (a) represented by general formula (I) and an alkaline earth metal compound (b), added during the polymer production process.

The polyethylene terephthalate polymer for the multifilament component (A) is produced by polycondensation of a dicarboxylic acid component containing terephthalic acid as the main component, and a glycol component containing ethylene glycol as the main component, and the polymer comprises main repeating units consisting of an ethylene terephthalate group.

The polyethylene terephthalate polymer for the multifilament component (A) may be a homopolymer or, if necessary, it may be a copolymer containing a small amount (preferably no greater than 30 mole percent) of a copolymerizing component. For the copolymerizing component, copolymerizable dicarboxylic acid compounds other than terephthalic acid may be selected from among, for example, aromatic, aliphatic and alicyclic difunctional carboxylic acids such as isophthalic acid, naphthalenedicarboxylic acid, diphenyldicarboxylic acid, diphenoxyethanedicarboxylic acid, β-hydroxyethoxybenzoic acid, P-oxybenzoic acid, 5-sodiumsulfoisophthalic acid, adipic acid, sebacic acid and 1,4-cyclohexanedicarboxylic acid. Copolymerizable diol components other than ethylene glycol may be selected from among, for example, aliphatic, alicyclic and aromatic diol compounds such as cyclohexane-1,4-dimethanol, neopentylglycol, bisphenol A and bisphenol S, and polyoxyalkylene glycols.

There are no special restrictions to the process for production of the polyethylene terephthalate resin composition for the multifilament component (A), and for example, in a first step terephthalic acid and ethylene glycol may be supplied directly to an esterification reaction, or a lower alkyl ester of terephthalic acid, such as dimethyl terephthalate, and ethylene glycol may be supplied to a transesterification reaction or terephthalic acid and ethylene oxide reacted, to produce an ethylene glycol ester of terephthalic acid and/or an oligomer thereof, while in a second step an ethylene glycol ester of terephthalic acid, or its oligomer, may be heated under reduced pressure for polycondensation reaction and the reaction completed when the polymerization degree of the polymer product has reached the desired polymerization degree.

The polyethylene terephthalate resin composition for the multifilament component (A) comprises polyethylene terephthalate polymer, with a metal-containing phosphorus compound (a) represented by general formula (I) and an alkaline earth metal compound (b), added during the polymer production process and, additionally, if necessary, a stabilizer, ultraviolet absorber, thickening or branching agent, matting agent, coloring agent or other modifiers.

The metal-containing phosphorus compound (a) is represented by the following general formula (I).

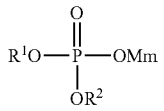

(I)

In formula (I), $R^1$ and $R^2$ represent monovalent organic groups. Specifically, the monovalent organic groups are preferably alkyl, aryl, aralkyl or $[(CH_2)_lO_k]R^3$ (where $R^3$ represents hydrogen, alkyl, aryl or aralkyl, l represents an integer of 2 or greater and k represents an integer of 1 or greater), and $R^1$ and $R^2$ may be either the same or different. M represents an alkali metal atom or alkaline earth metal atom, preferably Li, Na, K, Mg, Ca, Sr or Ba, and most preferably Ca, Sr or Ba. Also, m represents the value 1 when M is an alkali metal and represents the value ½ when M is an alkaline earth metal.

The metal-containing phosphorus compound (a) of general formula (I) forms fine pores of an appropriate size in the surfaces of the polyethylene terephthalate filaments of the multifilament component (A) used for the invention, in order to increase the bathochromic effect of the obtained combined-filament yarn or its product.

If a phosphorus compound of general formula (I), wherein $R^1$ and/or $R^2$ represent metal atoms (particularly alkali metal atoms or alkaline earth metal atoms), is used instead of the phosphorus compound of general formula (I), the fine pores produced on the surface of the polyester fibers of the multifilament component (A) will be too large in size, the desired bathochromic effect will be insufficient, and the fibrillating resistance will be inadequate.

The metal-containing phosphorus compound (a) can usually be easily produced by a heated reaction between the corresponding orthophosphoric acid ester (mono, di or tri) and a prescribed amount of the corresponding metal compound, in the presence of a solvent. The solvent used is preferably the glycol used as the starting material for the polyethylene terephthalate.

The alkaline earth metal compound (b) used in combination with the metal-containing phosphorus compound (a) may be one which reacts with the metal-containing phosphorus compound (a) to form a salt which is insoluble in polyethylene terephthalate, and as examples there may be mentioned organic carboxylic acid salts such as acetic acid salts, oxalic acid salts, benzoic acid salts, phthalic acid salts or stearic acid salts, inorganic acid salts such as boric acid salts, sulfuric acid salts, silicic acid salts, carbonic acid salts or bicarbonic acid salts, halides such as chlorides, chelate compounds such as ethylenediaminetetraacetic acid chelate salts, hydroxides, oxides, alcoholates such as methylates, ethylates or glycolates, and phenolates, of alkaline earth metals, and preferably the compound is selected from among organic carboxylic acid salts, halides, chelate compounds and alcoholates of alkaline earth metals, which are soluble in ethylene glycol.

Among these, organic carboxylic acid salts of alkaline earth metals are preferred. The alkaline earth metal compound (b) used may be of a single type, or a mixture of two or more types.

When preparing the polyethylene terephthalate resin composition for the multifilament component (A), the contents of the metal-containing phosphorus compound (a) and the alkaline earth metal compound (b) are preferably adjusted as appropriate in order to impart a high bathochromic effect and abrasion resistance to the obtained polyethylene terephthalate fibers. That is, the content of the metal-containing phosphorus compound (a) in the polyethylene terephthalate resin is preferably in the range of 0.5-3 mole percent and more preferably in the range of 0.6-2 mole percent with respect to the moles of the acid component in the polyethylene terephthalate polymer. The content of the alkaline earth metal (b) is preferably 0.5-1.2 times and more preferably 0.5-1.0 times the molar content of the metal-containing phosphorus compound.

If the content of the metal-containing phosphorus compound (a) in the polyester resin for the multifilament component (A) is less than 0.5 mole percent with respect to the acid component, the visual color density of the dyed multifilament component (A) may be inadequate, whereas if the content exceeds 3 mole percent, improvement of the bathochromic effect of the multifilament component (A) becomes saturated, the abrasion resistance is insufficient, the polymerization degree and softening point of the obtained polyester polymer may be unsatisfactory, and the spinning property of the polyester resin is impaired, resulting in increased yarn breakage during the spinning process.

If the content of the alkaline earth metal compound (b) is less than 0.5 with respect to the moles of the metal-containing phosphorus compound (a), the bathochromic effect of the obtained polyester fiber may be insufficient, the polycondensation speed during production of the polyethylene terephthalate polymer may be reduced, it may become difficult to obtain a polyethylene terephthalate polymer with a high polymerization degree, and the softening point of the obtained polyester polymer may be lowered; on the other hand, if the content of the alkaline earth metal compound (b) exceeds 1.2 times the number of moles of the metal-containing phosphorus compound (a), coarse particles may be produced in the polyester resin, possibly reducing the visual color density when the obtained multifilament component (A) is dyed.

The metal-containing phosphorus compound (a) and the alkaline earth metal compound (b) in the polyethylene terephthalate resin composition for the multifilament component (A) are added to the reaction system for production of the polyethylene terephthalate polymer, without prior reaction. This will allow the metal-containing phosphorus compound (a) and the alkaline earth metal compound (b) to react in the polyethylene terephthalate polymer which is produced, forming insoluble ultrafine particles in the polyethylene terephthalate polymer, which are evenly dispersed in the polymer.

If the metal-containing phosphorus compound (a) and the alkaline earth metal compound (b) are reacted beforehand to produce insoluble fine particles which are then added to the reaction system for production of the polyethylene terephthalate polymer, the dispersibility of the insoluble fine particles in the polyethylene terephthalate polymer is low and coarse particles may be formed, resulting in an inadequate improvement in the bathochromic effect of the obtained multifilament component (A).

The metal-containing phosphorus compound (a) and the alkaline earth metal compound (b) are added to the reaction system either simultaneously or separately, in any desired order, in at least one step from the start to the finish of production of the ethylene terephthalate polymer. However, if the metal-containing phosphorus compound (a) alone is added to the reaction system in the first step of the process for production of the polyethylene terephthalate polymer, completion of the reaction of that stage may be inhibited, while if the alkaline earth metal compound (b) alone is added to the reaction system before completion of the reaction in the first step, coarse particles may be formed in the reaction system when the reaction is an esterification reaction, or the reaction may proceed at an abnormal speed creating a bumping phenomenon when the reaction is a transesterification reaction. Thus, the amount of the alkaline earth metal compound (b) added in the first step is preferably limited to no greater than 20% by mass of the total added amount. That is, at least 80% by mass of the total added amount of the alkaline earth metal compound (b) is preferably added to the reaction system after the reaction of the first stage has been substantially completed. Also, addition of the metal-containing phosphorus compound (a) and the alkaline earth metal compound (b) is preferably completed before the limiting viscosity of the produced polymer reaches 0.3 in the second stage of the process for production of the polyethylene terephthalate polymer. When the reaction system exhibits a high viscosity during the second stage, addition of the metal-containing phosphorus compound (a) and the alkaline earth metal compound (b) to such a high viscosity reaction system may cause aggregation of the formed particles to produce coarse particles, resulting in an insufficient bathochromic effect of the obtained multifilament component (A).

The total amounts of both the metal-containing phosphorus compound (a) and the alkaline earth metal compound (b) may be added simultaneously, or they may be divided into two or more portions and added successively or continuously.

A catalyst may be used for the first and second stages of the production process for the polyethylene terephthalate polymer. However, as a substance capable of catalyzing the first stage reaction, and particularly the transesterification reaction (for example, an acetic acid salt, benzoic acid salt or sulfuric acid salt of an alkaline earth metal), is present in the alkaline earth metal compound (b), no catalyst need be used when such a catalytic alkaline earth metal compound is added to the reaction system in the first stage. When no catalyst is used, the alkaline earth metal compound (b) is added to the reaction system for the first stage during or before the reaction. In this case, however, the bumping phenomenon often occurs in the reaction system, and therefore the amount of the alkaline earth metal compound (b) added to the reaction system at the first stage is preferably limited to no greater than 20% by mass of the total amount of addition of the alkaline earth metal compound (b).

By adding the metal-containing phosphorus compound (a) and the alkaline earth metal compound (b) to the reaction system during the process for production of the polyethylene terephthalate polymer without reacting them beforehand, and completing the polycondensation reaction in the presence of both additives (a) and (b), it is possible to uniformly disperse the fine particles containing polyether additives (a) and (b) in the polyethylene terephthalate polymer. The polyethylene terephthalate resin composition prepared in this manner has a high polymerization degree, a high softening point and satisfactory filament formability, and allows production of a filament with high efficiency by a melt spinning process. The polyester filament for the multifilament component (A) also exhibits a good bathochromic effect when dyed, and excellent abrasion resistance, while also having a high alkali reduction rate. Consequently, when a polyester combined-filament yarn of the invention is supplied for alkali reduction treatment, the multifilament component (A) preferentially undergoes more rapid reduction than the conjugate multifilament component (B), thereby producing a good bathochromic effect and imparting a special color tone to the polyester combined-filament yarn.

The polyethylene terephthalate filament for the multifilament component (A) may be one which has been spun and drawn by an ordinary filament production process, but it may also be an undrawn filament. The undrawn polyethylene terephthalate filament preferably exhibits a self-elongation property when dry heated at a temperature of 180° C. Using such a self-elongating polyester filament gives a soft feel to the obtained polyester combined-filament yarn. A polyethylene terephthalate undrawn filament exhibiting a self-elongation property under dry heating at 180° C. as described above may be produced by melt spinning the aforementioned polyethylene terephthalate resin composition at a spinning speed of 2000-4300 m/min and winding it up, and then unwinding the undrawn filament while feeding it to a heat treatment step either in a relaxed state or with a 5-10% overfeed, and conducting heat treatment with a heater heated to 180-200° C.

The overall size and individual filament size of the multifilament component (A) in the polyester combined-filament yarn of the invention is not particularly restricted, but the overall size is preferably in the range of 33-330 dtex, and more preferably in the range of 33-220 dtex, while the individual filament size is preferably in the range of 1-5 dtex and more preferably in the range of 1.0-3.3 dtex. Also, the cross-sectional shapes of the polyester individual filaments for the multifilament component (A) are not restricted and may be any of various shapes including circular or polygonal such as triangular, or flat, or they may be hollow shapes.

The polyester combined-filament yarn of the invention comprises a multifilament component (A) with a conjugate multifilament component (B). The plurality of conjugate filaments composing the conjugate multifilament component (B) have a side-by-side or eccentric core-in-sheath conjugate fiber structure formed from two mutually different polyester resins, wherein at least one of the two different polyester resins is polytrimethylene terephthalate resin.

The mass ratio ((A)/(B)) of the multifilament component (A) with respect to the conjugate multifilament component (B) is in the range of 80:20 to 50:50, and preferably 80:20 to 60:40.

The conjugate filaments for the conjugate multifilament component (B) of the polyester combined-filament yarn of the invention have a side-by-side or eccentric core-in-sheath conjugate fiber structure formed from different polyester resins with different heat shrinkage properties. When the conjugate filaments are subjected to heat treatment, therefore, the difference in heat shrinkage properties of the two polyester resins results in coiled crimping, thereby imparting a stretch property to the conjugate multifilament component (B).

At least one of the polyester resins composing the conjugate filaments for the conjugate multifilament component (B) of the combined-filament yarn of the invention is polytrimethylene terephthalate resin. The major component of polytrimethylene terephthalate resin is polytrimethylene terephthalate polymer, and the main repeating unit of the polymer consists of a trimethylene terephthalate group. The trimethylene terephthalate group is formed by condensation reaction between an acid component comprising terephthalic acid and a glycol component comprising trimethylene glycol.

The trimethylene terephthalate polymer may be a homopolymer or a copolymer. When it is a copolymer, the acid component may contain one or more dicarboxylic acids other than terephthalic acid, for example, aromatic, aliphatic and alicyclic dicarboxylic acids such as isophthalic acid, naphthalenedicarboxylic acid, diphenyldicarboxylic acid, diphenoxyethanedicarboxylic acid, β-hydroxyethoxybenzoic acid, P-oxybenzoic acid, 5-sodiumsulfoisophthalic acid, adipic acid, sebacic acid and 1,4-cyclohexanedicarboxylic acid, as copolymerizing acid components, and the glycol component may contain one or more diol components other than ethylene glycol, for example, aliphatic, alicyclic and aromatic diol compounds such as cyclohexane-1,4-dimethanol, neopentylglycol, bisphenol A and bisphenol S, and polyoxyalkylene glycols, as copolymerizing glycol components. The content of such copolymerizing components is preferably no greater than 30 mole percent.

The polytrimethylene terephthalate resin may also contain, if necessary, a stabilizer, an ultraviolet absorber, a thickening or a branching agent, a matting agent, a coloring agent or other modifiers.

When one of the two different polyester resins forming the conjugate filaments for the conjugate multifilament conjugate (B) is a polyester resin different from polytrimethylene terephthalate, there are no particular restrictions on the type and composition of the different polyester resin and, for example, it may be selected from among polyethylene terephthalate homopolymer or copolymer. As the two different polyester resins composing the conjugate filament for the conjugate multifilament component (B) of the invention, there is preferably used a combination of two polytrimethylene terephthalate resins with different heat shrinkage properties, or a combination of polytrimethylene terephthalate resin and polyethylene terephthalate resin having different heat shrinkage properties, with the latter combination being more preferred. By using such differing polyethylene resins, for conjugate filaments having a side-by-side or eccentric core-sheath conjugate fiber structure, it is possible to obtain a conjugate multifilament component (B) exhibiting satisfactory crimping and shrinkage properties.

If at least one of the two different polyester resins composing the conjugate filaments for the conjugate multifilament component (B) of the polyester combined-filament yarn of the invention is polytrimethylene terephthalate resin then, when the combined-filament yarn obtained by combining the conjugate multifilament component (B) with the multifilament component (A) composed of polyethylene terephthalate filaments is subjected to alkali reduction treatment, alkali reduction of the polyethylene terephthalate filaments (multifilament component (A)) will occur preferentially due to the difference in alkali reduction rates between the polytrimethylene terephthalate resin and the polyethylene terephthalate resin composition.

The mass ratio of the two different polyester resins composing the conjugate filaments of the conjugate multifilament component (B) of the combined-filament yarn of the invention is preferably 70:30 to 30:70, and more preferably 60:40 to 40:60.

Although there are no particular restrictions on the overall thickness and individual conjugate filament thickness of the conjugate multifilament component (B), the overall size is preferably 33-330 dtex and more preferably 33-167 dtex, while the individual conjugate filament size is preferably 1-5 dtex and more preferably 1.0-3.3 dtex. Also, there are no particular restrictions on the cross-sectional shapes of the individual conjugate filaments, and they may be any of various shapes including circular or polygonal such as triangular, or flat, or they may be hollow shapes.

The mass ratio of the multifilament component (A) with respect to the conjugate multifilament component (B) in the polyester combined-filament yarn of the invention is preferably 80:20 to 50:50, and more preferably 75:25 to 60:40. If the mass ratio (A)/(B) is greater than 80/20, the shrinkage property of the obtained polyester combined-filament yarn will be insufficient, while if the mass ratio (A)/(B) is less than 50/50, the conjugate polyester fiber filaments of the conjugate multifilament component (B) in the obtained polyester combined-filament yarn and dyed woven or knitted fabrics produced therefrom will not be adequately covered by the polyethylene terephthalate fibers of the multifilament component (A) which have the high bathochromic effect, such that the conjugate polyester filaments of the conjugate multifilament component (B) which have an inferior bathochromic effect compared to the polyethylene terephthalate filaments of the multifilament component (A) will be exposed between the polyethylene terephthalate filaments with the high bathochromic effect, and the color difference between them may result in unsatisfactory quality of the dyed product. The mass ratio (A)/(B) is calculated by determining the ratio of the total weight of all the polyethylene terephthalate filaments composing the multifilament component (A) and the total weight of all the conjugate polyester filaments composing the conjugate multifilament component (B).

The polyester combined-filament yarn of the invention may also be used in combination with one or more different filaments, and the amount of such different filaments combined therewith is preferably no greater than 30% by mass and more preferably no greater than 20% by mass of the polyester combined-filament yarn of the invention.

There are no particular restrictions on the method for production of the combined-filament yarn of the invention and, as an example thereof, there may be employed a covering method in which the multifilament component (A) comprising a plurality of polyethylene terephthalate filaments is wound around a conjugate multifilament component (B) comprising a plurality of conjugate polyester filaments, or an air combining method in which the multifilament component (A) and the conjugate multifilament component (B) are supplied to an air entangling nozzle or to a combining/false twisting apparatus with the multifilament component (B) doubled on the outside, and the conjugate multifilament component (B) is used as the core with the polyethylene terephthalate filaments of the multifilament component (A) situated as the sheath around it and entangled with the conjugate polyester filaments situated on the outer periphery part of the conjugate multifilament component (B). An air combining method is preferred among these methods. Using the air combining method will yield a polyester combined-filament yarn with an excellent bulging feel (bulkiness) and flexibility.

In the air combining method described above, the multifilament component (A) and conjugate multifilament component (B) may be supplied at the same rate through the air entangling nozzle, but the supply rate of the multifilament component (A) may instead be higher than that of the conjugate multifilament component (B) (i.e., overfed).

After combining the multifilament component (A) and conjugate multifilament component (B), heat treatment of the obtained combined-filament yarn can produce coiled crimping in the conjugate polyester filament in the conjugate filament component (B), allowing an apparent shrinkage to be achieved. This will construct a core of the combined filament as a conjugate filament component with apparent shrinkage, while the polyethylene terephthalate filaments of the multifilament component (A) which do not exhibit crimping are distributed around the core to form the sheath of the combined-filament yarn. The polyethylene terephthalate filaments composing such a sheath bend around the core and exhibit bulkiness, so that the obtained combined-filament yarn exhibits a high stretch property.

An example of a method for producing the combined-filament yarn of the invention will now be explained with reference to FIG. 1.

In FIG. 1, the multifilament component (A) and conjugate multifilament component (B) are unwound from their respective packages 1A and 1B, are made parallel and are supplied to a supply roll 1, and the parallel yarn 1*a* is supplied through a yarn guide 1*b* to an air entangling nozzle 2 to form a combined-filament yarn 2*a*, after which the combined-filament yarn 2*a* is supplied through a yarn guide 2*b* to a first heating apparatus (heating roll) 3 at a prescribed feeding speed (optionally with an overfeed) and heated to a prescribed temperature. It is wound around the circumference of the roll at least once and contacted therewith for a first heat treatment (optional relaxation heat treatment). The combined-filament yarn 3*a* which has been subjected to the first heat treatment is fed to a second heating apparatus 4 and subjected to a second heat treatment at a prescribed temperature between, for example, a pair of slit heaters. Here, the combined-filament yarn which has been subjected to the first heat treatment may be fed to the second heating apparatus 4 in a relaxed (overfeed) state. The multifilament component (A) and conjugate multifilament component (B) in the combined-filament yarn 3*a* are heat set in a prescribed state and in a distributed position, in the second heating apparatus 4. The obtained combined-filament yarn 4*a* which has been subjected to the second heat treatment is taken up by a take-up roll 5, cooled and wound up through a yarn guide 6*a* around a bobbin 6*b* to form a combined-filament yarn package 6. A woven or knitted fabric of the present invention is constituted from the polyester combined-filament yarns of the present invention. The combined-filament yarn of the present invention used in the woven or knitted fabric may be an untwisted yarn, but preferably it is twisted at 150-3000 T/m, and more preferably the number of twists is 600-2000 T/m.

The polyester combined-filament yarn for a woven or knitted fabric according to the present invention preferably comprises a core section composed of the conjugate multifilament component (B) which exhibits coiled crimping by the aforementioned heat treatment and a bulky sheath section formed from the multifilament component (A), which is incorporated around it and bent to protrude outward; such a combined-filament yarn imparts a satisfactory stretch property to the woven or knitted fabric.

There are no particular restrictions on the structure of the polyester combined-filament yarn woven or knitted fabric present of the invention, and the weaving structure of a woven fabric may be, for example, any of the three primary weaves, i.e. plain weave, twill weave or satin weave, or a modification of such weaves, a partial double weave (warp double weave or weft double weave), a warp velvet weave, or the like. Knitting structures include weft knitting structures and warp knitting structures, with the preferred examples of weft knitting structure including plain stitch, rib stitch, double knit, pearl stitch, tuck stitch, float stitch, half cardigan stitch, lace stitch and plated stitch, and preferred examples of warp knitted textures including single Denbigh stitch, single atlas stitch, double cord stitch, half-tricot stitch, lined stitch and Jacquard stitch. The number of knitted layers may be one or more than one.

The polyester combined-filament yarn of the present invention preferably constitutes at least 30%, more preferably at least 40% and most preferably 100% of a woven or knitted fabric of the invention based on the total weight of the woven or knitted fabric.

Alkali reduction processing of a woven or knitted fabric of the invention forms fine pores in the fiber surfaces of the polyethylene terephthalate fibers in the woven or knitted fabric. The alkali reduction rate is preferably in the range of 5-40% and more preferably 15-30% based on the weight of the combined-filament yarn. As polyethylene terephthalate has a higher alkali reduction rate than polytrimethylene terephthalate, the polyethylene terephthalate filaments undergo alkali reduction preferentially to the conjugate filaments. If the alkali reduction rate is less than 5%, the fine pores may not be sufficiently formed in the fibers surfaces of the polyethylene terephthalate filaments. Conversely, if the alkali reduction rate is greater than 40%, the conjugate filaments may also undergo alkali reduction, thereby impairing the stretch property of the woven or knitted fabric.

When the woven or knitted fabric of the invention is subjected to a dyeing process, the fine pores formed on the fiber surfaces of the polyethylene terephthalate filaments produce an excellent bathochromic effect. At the same time, as the conjugate filaments in the core-sheath combined-filament yarn exhibit coiled crimping under the heat of the dyeing process, an excellent stretch property is also obtained. Moreover, as the polyethylene terephthalate filaments and conjugate filaments in the combined-filament yarn are in the aforementioned ranges, the polyethylene terephthalate filaments compose the sheaths while the conjugate filaments compose the cores, and therefore the conjugate filaments are not exposed at the surface of the woven or knitted fabric and no dyeing difference is produced.

The difference in apparent color density of the polyethylene terephthalate filaments and conjugate filaments is not exposed.

A woven or knitted fabric of the present invention may be subjected to water repellent processing or raising, or it may be subjected to a treatment process with various agents which impart functions such as ultraviolet blocking properties, or antimicrobial agents, deodorants, insecticides, luminous agents, retroreflective agents, minus-ion generators and the like.

EXAMPLES

The present invention will be farther explained in detail by the following examples. These examples, however, are not intended to restrict the scope of the invention, in any way.

The starting materials and products of the examples were subjected to the following measurements.

1. Intrinsic Viscosity

Measured at a temperature of 35° C. using orthochlorophenol as the solvent.

2. Bathochromic Effect

The bathochromic degree (K/S) was used as a measure of the bathochromic effect. This value is determined by measurement using a Shimadzu RC-330 recording spectrophotometer and calculation from the following Kubelka-Munk formula. A larger value indicates a greater bathochromic effect.

$$K/S=(1-R)^2/2R$$

K represents the optical absorption coefficient, and S represents the light scattering coefficient.

3. Stretch Property

A tensile tester by Shimadzu Laboratories was used for stretching of a test fabric piece in the weft direction, and the stretch property of the test fabric piece was expressed as the elongation (%) under a stress of 2.94 N/cm with a grip width of 2 cm, a grip spacing of 10 cm and a pull rate of 10 cm/min. If the stretch property of the fabric is not at least 10%, it is not suitable as a multipurpose stretchable fabric.

4. Fabric Quality

The surface of the fabric was observed by 5 panelists, who conducted evaluation of differences in color density of the core and sheath of the combined-filament yarn based on the presence of "pock marks", and specifically on the 3-level scale of "no pock marks" (3), "few pock marks" (2) and many "pock marks" (1).

Example 1

After charging 100 parts of dimethyl terephthalate, 60 parts of ethylene glycol and 0.06 part of calcium acetate monohydrate (0.066 mole percent with respect to the dimethyl terephthalate) in a transesterification reactor, the temperature was raised from 140° C. to 230° C. over a period of 4 hours under a nitrogen gas atmosphere, and transesterification was carried out while distilling the produced methanol out of the system. To the obtained reaction product there was then added 9.88 parts of a transparent solution comprising a mixture of a calcium phosphate diester and calcium acetate, and then 0.04 part of antimony trioxide was added prior to transfer of the mixture to a polymerization canister. The transparent solution comprising the mixture of the calcium phosphate diester and calcium acetate was prepared in the following manner. Specifically, 0.5 part of trimethyl phosphate (0.693 mole percent with respect to the dimethyl terephthalate) and 0.31 part of calcium acetate monohydrate (½ molar proportion with respect to the trimethyl phosphate) were reacted in 8.5 parts of ethylene glycol at a temperature of 120° C. under full circulation for 60 minutes, and then 0.57 part of calcium acetate monohydrate (0.9 molar proportion with respect to the trimethyl phosphate) was dissolved in 9.31 parts of the thus prepared calcium phosphate diester transparent solution at room temperature to prepare the transparent mixed solution.

The pressure in the polymerization canister containing the reaction mixture was reduced from 760 mmHg to 1 mmHg over a period of 1 hour, while the temperature was simultaneously raised from 230° C. to 285° C. over a period of 1 hour and 30 minutes. Polymerization was conducted for an additional 3 hours under a reduced pressure of below 1 mmHg and a polymerization temperature of 285° C., for a total of 4 hours and 30 minutes, to obtain a polymer with an intrinsic viscosity of 0.641 and a softening point of 259° C. The polymer after completion of the reaction was formed into chips using a pelletizer.

The chips were dried and supplied to a melt spinning apparatus having 36 spinning holes, and then spun at a spinning speed of 3300 m/min to produce a polyethylene terephthalate undrawn filament bundle (intermediate combined filament bundle) with 90 dtex/36 filaments, comprising a metal-containing phosphorus compound and an alkaline earth metal compound.

Separately, polytrimethylene terephthalate (PTT) with an intrinsic viscosity of 1.31 and polyethylene terephthalate (PET) with an intrinsic viscosity of 0.52 were each melted and supplied to a side-by-side conjugate fiber melt spinning apparatus having 24 spinning holes, and then discharged from the conjugate spinning nozzle at a spinning temperature of 260° C. at a mass proportion of PET/PTT=50/50, for spinning at a spinning speed of 1450 m/min. The obtained undrawn filament bundle was stretched to a factor of 2.9 at 87° C. to produce a drawn conjugate filament with 56 dtex/24 filaments.

The polyethylene terephthalate undrawn filament bundle (A) and conjugate filament bundle (B) including the metal-containing phosphorus compound and alkaline earth metal compound were used to produce a combined-filament yarn with an apparatus as shown in FIG. 1. Specifically, the undrawn multifilament bundle (A) and the conjugate multifilament bundle (B) were both unwound from their respective packages 1A and 1B, made parallel and supplied to a supply roll 1, and the parallel yarn 1*a* was supplied through a yarn guide 1*b* to an interlacing nozzle (air entangling nozzle) 2 at a supply rate of 600 m/min and an overfeed rate of 1.2%, while air pressurized to 0.2 MPa (2 kgf/cm$^2$) was blown onto it to entangle together the filaments of the paralleled yarn 1*b*. The entangled filament bundle 2*a* was supplied through a yarn guide 2*b* to a first heating roll 3 at an overfeed rate of 1.2% and wound 8 times around the perimeter of the first heating roll having a surface temperature of 120° C. for relaxation heat treatment of the entangled filament bundle, whereby a self-elongation property at 180° C. was imparted to the polyethylene terephthalate filament (A). The filament bundle which had been subjected to the first heat treatment was fed to a second heat treatment apparatus 4 at an overfeed rate of 1.8%, and a second relaxation heat treatment was carried out for 0.05 second at 230° C. with a pair of slit heaters, for heat setting of the test filament bundle to produce the target combined-filament yarn. The heat set combined-filament yarn 4*a* was wrapped 4 times around a take-up roll and then drawn out and wound up through a yarn guide 6*b* onto a wind-up bobbin 6*b* to form a combined-filament yarn package 6.

The combined-filament yarn obtained by the process described above was wound out from the package and twisted in the S direction at 1200 T/m.

A woven fabric was produced from the obtained combined-filament yarn, having a 2/2 twill pattern with a warp density of 101 strands/2.54 cm and a weft density of 82 strands/2.54 cm.

The woven fabric was immersed in an alkali reduction treatment solution containing sodium hydroxide at a concentration of 35 g/liter, and alkali reduction treatment was carried out at 95° C. for 60 minutes. The reduction rate of the fabric by the treatment was 25% (by weight).

The woven fabric subjected to alkali reduction treatment was fed to a dyeing step and subjected to dyeing at 130° C. for 60 minutes in a dyeing bath containing 15% (by weight with respect to the fabric weight) of a disperse dye (Dianin Black HG-FS™, Mitsubishi Chemical Co., Ltd.). The dyed fabric was then subjected to reduction washing at 70° C. for 20 minutes in an aqueous solution containing 1 g/liter sodium hydroxide and 1 g/liter hydrosulfite, to obtain a black-dyed woven fabric.

The test results for the obtained black woven fabric are shown in Table 1. The black woven fabric had a satisfactory stretch property and bathochromic effect, as well as satisfactory apparent color density uniformity.

Example 2

A black combined-filament yarn woven fabric was produced in the same manner as Example 1. However, the conjugate multifilament component (B) was produced using polytrimethylene terephthalate (PTT) with an intrinsic viscosity of 1.26 and polytrimethylene terephthalate (PTT) with an intrinsic viscosity of 0.92. The test results are shown in Table 1. The black woven fabric had a satisfactory stretch property and bathochromic effect, as well as satisfactory apparent color density uniformity.

Comparative Example 1

A black woven fabric was produced in the same manner as Example 1. However, the mass ratio (B)/(A+B) of the conjugate multifilament component (B) with respect to the total weight of the multifilament component (A) and conjugate multifilament component (B) in the combined-filament yarn was 17%, or in other words, the mass ratio of (A)/(B) was 83:17.

The test results are shown in Table 1. As the content of the conjugate multifilament component (B) in the obtained black woven fabric was too low, the stretch property of the obtained black woven fabric was insufficient.

Comparative Example 2

A black woven fabric was produced in the same manner as Example 1. However, the mass ratio of the conjugate multifilament component (B) with respect to the total weight of the multifilament component (A) and conjugate multifilament component (B) in the combined-filament yarn was 53%. That is, the mass ratio of (A)/(B) was 47:53. The test results are shown in Table 1.

As the content of the multifilament component (A) in the obtained black woven fabric was too low, the apparent color density uniformity of the obtained black woven fabric was unsatisfactory.

Comparative Example 3

A black combined-filament yarn woven fabric was produced in the same manner as Example 1. However, polyethylene terephthalate (PET) polymer with an intrinsic viscosity of 0.65 and polyethylene terephthalate (PET) with an intrinsic viscosity of 0.50 were used for production of the conjugate filament for the conjugate multifilament component (B).

The test results are shown in Table 1.

The obtained black woven fabric was unsatisfactory in terms of bathochromic effect.

TABLE 1

| | | | | Example 1 | Example 2 | Comp. Ex. 1 | Comp. Ex. 2 | Comp. Ex. 3 |
|---|---|---|---|---|---|---|---|---|
| Polyethylene terephthalate fiber | Fine pore-forming agent | Metal-containing phosphorus compound | Type | Ca phosphate diester | Ca phosphate diester | Ca phosphate diester | Ca phosphate diester | Ca phosphate diester |
| | | | Addition amount (mol % to DMT) | 0.693 | 0.693 | 0.693 | 0.693 | 0.693 |
| | | Alkaline earth metal compound | Type | Ca acetate | Ca acetate | Ca acetate | Ca acetate | Ca acetate |
| | | | Molar ratio of added Ca/P | 1.5 | 1.5 | 1.5 | 1.5 | 1.5 |
| Conjugate fiber | Constituent components | | | PET/PTT | PTT/PTT | PET/PTT | PET/PTT | PET/PET |
| | Mass ratio to total combined-filament yarn (%) | | | 37 | 37 | 17 | 53 | 37 |
| Fabric properties | Bathochromic effect (K/S) | | | 26 | 27 | 25 | 22 | 22 |
| | Stretch property | | | 20 | 22 | 7 | 26 | 21 |
| | Quality (dyeing difference between core and sheath | | | Good | Good | Good | Bad | Good |

INDUSTRIAL APPLICABILITY

The polyester combined-filament yarn of the present invention is a useful yarn for obtaining woven or knitted fabric having an excellent stretch property and a bathochromic effect, as well as uniformity of apparent dyed color density and is, therefore, useful for such purposes as various types of women's and men's fashion apparel, black formal woven or knitted fabrics and fabrics for traditional middle-eastern garments and the like.

What is claimed is:

1. A combined-filament yarn comprising a multifilament component (A) and a conjugate multifilament component (B) which are combined together, characterized in that the multifilament component (A) comprises a plurality of filaments comprising a polyethylene terephthalate resin composition, the polyethylene terephthalate resin composition comprising polyethylene terephthalate polymer, with a metal-containing phosphorus compound (a) represented by the general formula (I):

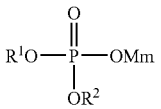

(I)

wherein $R^1$ and $R^2$ respectively and independently from each the represent a monovalent organic group, M represents an alkali metal atom or alkaline earth metal atom, and m represents an integer of 1 when M is an alkali metal atom and represents a numeric of ½ when M is an alkaline earth metal atom, and an alkaline earth metal compound (b), the metal-containing phosphorus compound (a) and alkaline earth metal compound (b) being mixed, during the production process for the polyethylene terephthalate polymer, into the reaction mixture, the conjugate multifilament component (B) comprises a plurality of polyester conjugate filaments having a side-by-side or eccentric core-sheath conjugate fiber structure formed from two mutually different polyester resins, wherein at least one of the two different polyester resins is polytrimethylene terephthalate resin, and the mass ratio ((A)/(B)) of the multifilament component (A) with respect to the conjugate multifilament component (B) is in the range of 80:20 to 50:50.

2. The combined-filament yarn according to claim 1, wherein in the polyethylene terephthalate filaments contained in the multifilament component (A), the metal-containing phosphorus compound (a) is contained in a content of 0.5-3.0 mole percent of the molar amount of the terephthalic acid component contained in the polyethylene terephthalate resin, and the alkaline earth metal compound (b) is contained in the content of 50-120 mole percent of the molar amount of the metal-containing phosphorus compound (a).

3. The combined-filament yarn according to claim 1, wherein the polyethylene terephthalate filament of the multifilament component (A) is selected from undrawn multifilaments that exhibit a self-elongation property upon dry heating at 180° C.

4. The combined-filament yarn according to claim 1, wherein the side-by-side or eccentric core-in-sheath polyester conjugate filament in the multifilament component (B) is constituted from a polyethylene terephthalate resin and a polytrimethylene terephthalate resin.

5. The combined-filament yarn according to claim 1, wherein the multifilament component (A) and conjugate multifilament component (B) are combined by passing through an air entangling nozzle, whereby the individual filaments of the components (A) and (B) are combined and entangled with each other.

6. The combined-filament yarn according to claim 1, having a number of twists of 150-3000 T/m.

7. A woven or knitted fabric comprising a polyester combined-filament yarn according to claim 1.

8. The woven or knitted fabric according to claim 7, wherein a plurality of fine pores are formed in the filament surfaces of the polyethylene terephthalate filaments contained in the combined-filament yarn, by an alkali reduction treatment.

9. The woven or knitted fabric according to claim 7, wherein at least one type of the filaments contained in the multifilament components (A) and (B) are colored by a dyeing treatment.

10. A woven or knitted fabric comprising a polyester combined-filament yarn according to claim 2.

11. A woven or knitted fabric comprising a polyester combined-filament yarn according to claim 3.

12. A woven or knitted fabric comprising a polyester combined-filament yarn according to claim 4.

13. A woven or knitted fabric comprising a polyester combined-filament yarn according to claim 5.

14. A woven or knitted fabric comprising a polyester combined-filament yarn according to claim 6.

15. The woven or knitted fabric according to claim 2, wherein a plurality of fine pores are formed in the filament surfaces of the polyethylene terephthalate filaments contained in the combined-filament yarn, by an alkali reduction treatment.

16. The woven or knitted fabric according to claim 3, wherein a plurality of fine pores are formed in the filament surfaces of the polyethylene terephthalate filaments contained in the combined-filament yarn, by an alkali reduction treatment.

17. The woven or knitted fabric according to claim 4, wherein a plurality of fine pores are formed in the filament surfaces of the polyethylene terephthalate filaments contained in the combined-filament yarn, by an alkali reduction treatment.

18. The woven or knitted fabric according to claim 2, wherein at least one type of the filaments contained in the multifilament components (A) and (B) are colored by a dyeing treatment.

19. The woven or knitted fabric according to claim 3, wherein at least one type of the filaments contained in the multifilament components (A) and (B) are colored by a dyeing treatment.

20. The woven or knitted fabric according to claim 4, wherein at least one type of the filaments contained in the multifilament components (A) and (B) are colored by a dyeing treatment.

* * * * *